US005340661A

United States Patent [19]

Van Havenbergh et al.

[11] Patent Number: 5,340,661

[45] Date of Patent: Aug. 23, 1994

[54] RADIOGRAPHIC SCREEN WITH EDGE-REINFORCING COATING

[75] Inventors: Jan A. Van Havenbergh, Zwijndrecht; Jozef R. Aertbelien, Schilde, both of Belgium

[73] Assignee: AGFA-Gevaert, N.V., Mortsel, Belgium

[21] Appl. No.: 842,603

[22] Filed: Feb. 27, 1992

[30] Foreign Application Priority Data

Mar. 8, 1991 [EP] European Pat. Off. ..... 91200511.3

[51] Int. Cl.[5] ..... G03C 1/79

[52] U.S. Cl. ..... 428/690; 428/908.8; 428/483; 428/192; 250/483.1; 250/484.2; 430/534; 430/536; 430/139

[58] Field of Search ..... 428/908.8, 68, 690, 428/917, 483, 81, 192, 215, 336; 250/483.1, 483.4, 488.1, 327.2; 430/534, 536, 139, 537

[56] References Cited

U.S. PATENT DOCUMENTS 4,510,388 4/1985 Yamazak et al. ..... 250/327.2

4,741,993 5/1988 Kano et al. ..... 430/536

*Primary Examiner*—Charles R. Nold

*Attorney, Agent, or Firm*—Breiner & Breiner

[57] ABSTRACT

A radiographic screen comprising a support, a layer comprising a fluorescent phosphor dispersed in a binder and a protective topcoat coated over the phosphor binder layer, wherein the edges are reinforced by a radiation cured coating obtained by curing a radiation curable composition comprising a polyester prepolymer, and a diluent mono-functional monomer.

6 Claims, 1 Drawing Sheet

RADIOGRAPHIC SCREEN WITH EDGE-REINFORCING COATING

DESCRIPTION

1. Field of the Invention

The present invention relates to radiographic screens for use in medical diagnosis, more in particular it relates to radiation cured coatings suitable for reinforcing the edges of a radiographic screen.

2. Background Art

In conventional radiography, particularly medical radiography, an X-ray image is obtained by irradiating X-rays transmitted through a subject on an X-ray conversion screen containing on a support a layer of fluorescent phosphor which absorbs X-rays and converts them into visible light and/or ultraviolet radiation when struck by X-rays; said visible light then irradiates a film coated with a silver halide emulsion layer which is subsequently developed. The X-ray films which are used generally comprise a transparent film support coated on each of its faces with a silver halide emulsion layer. Two X-ray conversion screens are usually employed, one positioned on each side of the double-side coated film; the film together with the two screens are usually encased in a suitable cassette. Combinations of single emulsion films with single screens are often used in high definition applications (extremities, mammography).

In recent years, methods producing images directly from the phosphor layer without use of a film coated with a silver salt have been devised. A description of such methods can be found in U.S. Pat. Nos. 3,859,527, 4,239,968, 4,258,264, 4,654,533 and 4,710,626. In such a method, X-ray radiation transmitted through a subject is irradiated on a stimulable phosphor layer of a stimulable X-ray conversion screen to accumulate radiation energy corresponding to the radiation transmission degrees at respective portions of the subject and forming a latent image, then the stimulable phosphor layer is scanned with a stimulating excitation light, thereby releasing the radiation energy stored at the respective portions as light emission, and subsequently an image is obtained according to the optical signals depending on the intensity of the emitted light. The image may be processed and the obtained final image may be reproduced as a hard copy or reproduced on CRT. The stimulable phosphor sheet does not serve to finally record image information, but only stores the information temporarily to provide the image or the like on an independently prepared final recording medium. Accordingly, the stimulable phosphor sheet can, after being erased, be repeatedly used.

Traditionally, X-ray conversion screens comprise, in order, a support, an active layer comprising a fluorescent phosphor dispersed in a suitable binder and a protective topcoat or abrasion layer coated over the active layer to protect said active layer during use. The term X-ray conversion screens, fluorescent phosphor and the like as used herein refers to screens, phosphors or the like for use in conventional screen-film combinations as well as to stimulable screens, phosphors or the like.

Since each radiographic screen is used frequently, it is important to provide them with an adequate topcoat effectively protecting the active layer from physical and chemical deterioration. This is particularly important in stimulable radiographic screens where the screen is not encased in a cassette but is used and handled as such. Use of a radiation curable coating as protective toplayer in a X-ray conversion screen as described in, e.g., EP 209358 and JP 86/176900, has provided satisfactory results.

When a radiographic screen with the structure described above is used in a radiation image recording an reproduction method, the edge faces of the screen, particularly the phosphor layer portions in the edge faces of the screen, are easily damaged. Edge-reinforcement of the radiographic screen is then a suitable solution.

Conventional radiographic screens may be conventionally edge-reinforced with materials such as cellulose acetobutyrate, nitrocellulose acrylate or resins such as vinyl acetate resin and vinyl chloride resin, acting as abrasion resistant material.

The above mentioned materials generally cannot satisfactorily be used for edge-reinforcement of stimulable phosphor screens or so-called radiation image storage screens or panels. This is because the radiation image storage panels are handled more roughly and consequently the screens are liable to receive severe mechanical shocks in contrast to conventional radiographic intensifying screens which are always held in a cassette.

The repeated use in a continuous cycle of exposing the stimulable phosphor screen to radiation, reading out the radiation image recorded therein, and removing the remaining radiation energy in the screen implies moving the screen through the various processing stations.

Therefore in view of the considerably higher rough handling of stimulable phosphor screens as compared to conventional screens, conventional edge-reinforcement materials do not yield satisfactory results in case of stimulable phosphor screens.

The solutions of edge-reinforcement of stimulable phosphor screens such as described e.g. in EP-A-83470, comprising coating the edge faces of a stimulable phosphor screen with a polymer material comprising polyurethane or acrylic resin, also are not satisfactory, and imply various disadvantages such as the use of solvents which inhibit an easy and efficient production method. Indeed according to said prior art the edge-reinforcement is performed by dissolving the polymer material in a suitable solvent to prepare a solution of the polymer material (edge-reinforcing solution) applying the solution to the edge faces of the screen and then drying the coating of the solution. The removal of said solvents by evaporation causes an additional lengthy drying step during the manufacture of the screens and implies also ecological problems. Further, from the point of view of mechanical strength, edge-reinforcements based upon such coatings do not yield satisfactory results.

In view of the above, edge-reinforcement of radiographic screens by applying radiation curable compositions appears to be an appropriate solution. From the point of view of mechanical strength and abrasion resistance radiation curable compositions are preferred over the more conventional protective coatings. However, the adhesion of the radiation curable compositions to the edges of the radiographic screens causes problems. Due to the numerous shocks and rough handling of the screens, in particular the stimulable phosphor screens, edge-reinforcements based upon radiation curable coatings are easily damaged, and tend not to adhere firmly any more to the edges of the screen. The cause hereof is that the edge reinforcing coating should exhibit good adhesive properties towards chemically quite distinct materials; the edges of the phosphor layer itself, comprising inorganic phosphor pigments cemented by a small amount of an organic binder medium, optionally a radiation cured protective topcoat, and the thermoplastic film support, usually made of polyethyleneterephthalate. The radiation curable coating compositions described in the prior art show poor adhesion properties to either the protective topcoat, either the phosphor/-binder mixture, and/or the thermoplastic film support of the radiographic screen. Due to this poor adhesion, the benefits of the inherent high abrasion resistance and mechanical strength of an edge reinforcing coating based upon a radiation curable composition are lost.

OBJECT OF THE INVENTION

It is therefore an object of the present invention to provide a radiographic screen the edges whereof are firmly reinforced.

It is a further object of the present invention to provide a radiographic screen the edges whereof are reinforced by a coating exhibiting excellent physical properties such as abrasion resistance.

More in particular it is an object of the present invention to provide a radiographic screen, the edges whereof are reinforced by a radiation cured composition exhibiting good adhesive properties to the phosphor layer, a radiation cured protective coating on top of said phosphor layer, and the thermoplastic film support made of e.g. polyethylene terephthalate.

Further objects will become apparent from the description hereinafter.

SUMMARY OF THE INVENTION

According to the present invention there is provided a radiographic screen comprising a support, a layer comprising a fluorescent phosphor dispersed in a binder and a protective topcoat coated over the phosphor layer, characterised in that the edges of the screen are reinforced by a radiation cured coating obtained by curing a radiation curable composition comprising a polyester as prepolymer, and a diluent mono-functional monomer.

According to a preferred embodiment said radiographic screen is in addition characterised in that its edges are reinforced by a radiation cured coating obtained by curing a radiation curable composition comprising a copolymer of ethylene terephthalate/isophthalate as polyester and a methacrylate, preferably methylmethacrylate or tetrahydrofurfurylmethacrylate, as mono-functional diluent monomer.

Further preferred embodiments will become apparent from the description hereinafter.

BRIEF DESCRIPTION OF THE INVENTION

In the drawing,

FIG. 1 is a diagrammatic representation of a preferred embodiment of a coating device for applying the radiation-curable composition of the invention to the edges of a radiographic screen; and FIG. 2 is a diagrammatic side view of the device of FIG. 1 from the direction of arrow A in FIG. 1.

DETAILED DESCRIPTION OF THE INVENTION

Radiation Curable Composition

Figure 1:
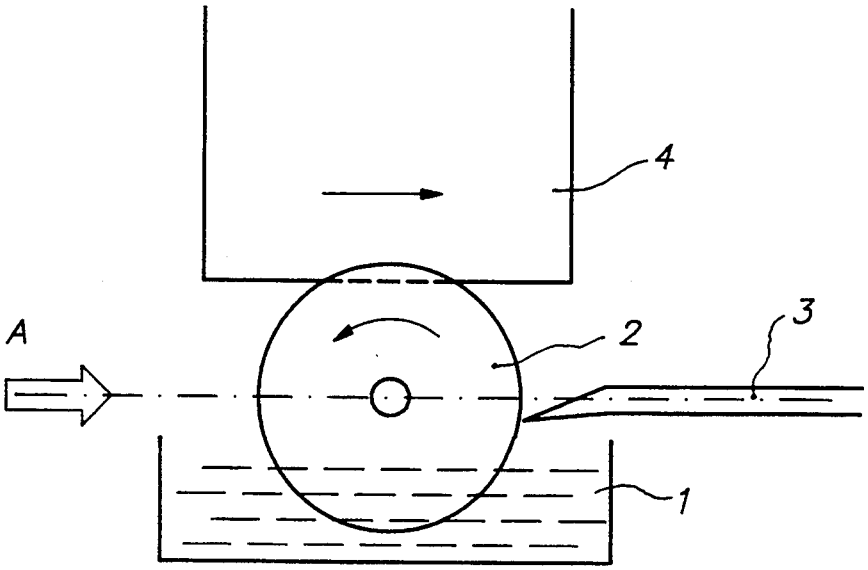

The radiation curable composition suitable for edge-reinforcing the radiographic screen according to our invention contains a polyester prepolymer, a reactive diluent mono-functional monomer and in the case of an UV curable formulation a photoinitiator. The usual amounts of these primary components are 30–100% by weight for the prepolymer, 10–70% by weight for the reactive diluent and 0–10% by weight for the photoinitiator.

In addition to these primary components additives may be added in an amount of 0–10% by weight. As additives may be used surfactants, waxes, defoamers, plasticizers and stabilizers. Pigments may be added in an amount of 0–60% by weight.

Prepolymer

As the polyester prepolymer, there may be exemplified the following: unsaturated polyesters; modified. unsaturated polyesters such as urethane modified unsaturated polyester, acrylic urethane modified unsaturated polyester, and a liquid unsaturated polyester having an acrylic group as a terminal group.

The radiation curing type resin mentioned above may be employed alone or as a mixture of two or more.

As will be illustrated by the examples set forth hereinafter, the objects set forth above can be met by an appropriate selection of prepolymer compounds in combination with mono-functional diluent monomers. The preferred polyester type prepolymers according to our invention are in particular the copolymer of ethylene terephthalate and isophthalate.

It may be noted that such ethylene terephalate/isophtalate polyester copolymer, such as the one commercially available under the trade name Vitel PE 200 for Goodyear Chemicals Akron, Ohio, USA, is in fact a saturated polymer not having two or more unsaturated double bonds which are conventionally a perequisite for obtaining a curable resin composition. Surprisingly however, it has been noted that when such Vitel type polyester resin is used along with a monofunctional diluent monomer, upon ultraviolet or electron beam irradiation a radiation curable coating with excellent adhesive properties towards the edges of a radiographic screen is obtained.

Diluent Monomers

Diluent monomers are used in radiation curable formulations to reduce the viscosity and to increase flow characteristics. These monomers participate in the free radical curing process. As the abovementioned reactive diluent monomers, reducing the viscosity of the composition and enhancing the radiation curing rate, there may be exemplified the following mono-functional monomers: methyl (metha) acrylate, ethyl acrylate, butyl acrylate, 2-ethylhexyl methacrylate, 2-hydroxyethyl acrylate, 2-hydroxyethyl methacrylate, glycidyl methacrylate, n-hexyl acrylate, lauryl acrylate, tetrahydrofurfurylmethacrylate etc. Apart from the abovementioned mono-functional diluent monomers di-functional monomers such as 1,6-hexanediol diacrylate, 1,6-hexanediol dimethacrylate, silicone diacrylate, neopentylglycol, 1,4-butanediol diacrylate, ethyleneglycol diacrylate, polyethyleneglycol diacrylate, pentaerythritol diacrylate, divinylbenzene, etc. and tri- or more-functional monomers such as trimethylolpropane triacrylate, trimethylolpropane trimethacrylate, pentaerythritol triacrylate, dipentaerythritol hexaacrylate, an acrylate of ethylenediamine, aliphatic and aromatic urethane acrylates, etc. may also be used as diluent monomers in curable compositions suitable for edge-reinforcing radiographic screens without however attaining the objects of our invention.

We have found indeed that the objects set forth above can be met when, in combination with the polyester type prepolymers, mono-functional monomers are used as diluent monomers as will be illustrated by the examples hereinafter. Preferred mono-functional monomers are the following methacrylate compounds: methylmethacrylate and tetrahydrofurfuryl methacrylate.

Photoinitiator

If ultraviolet irradiation is employed as a means for curing, there is added a photoinitiator which is a catalyst to initiate the polymerization by absorption of ultraviolet ray energy, and further there may be added a photosensitizer for accelerating the effect of the photoinitiator by transferring energy and forming free radicals by interaction.

As the abovementioned photoinitiator, carbonyl compounds may be frequently employed, for example, benzoin ether series compounds such as benzoin isopropyl, isobutylether; benzil ketal series compounds; ketoxime esters; benzophenone series compounds such as benzophenone, o-benzoylmethylbenzoate; acetophenone series compounds such as acetophenone, trichloroacetophenone, 1,1-dichloroacetophenone, 2,2-diethoxyacetophenone, 2,2-dimethoxy-2-phenylacetophenone; thioxanthone series compounds such as 2-chlorothioxanthone, 2-ethylthioxanthone; and compounds such as 2-hydroxy-2-methylpropiophenone, 2-hydroxy-4'-isopropyl-2- methylpropiophenone, 1-hydroxycyclohexylphenylketone; etc.

A particularly preferred photoinitiator for incorporation into the curable resin compositions of our invention is 2-hydroxy-2 methyl-1-phenyl-propan-1-one (tradename DAROCUR 1173, supplied by E. Merck, Darmstadt, W. Germany).

The above mentioned photopolymerization initiator may be used alone or as a mixture of two or more.

As the examples of the photosensitizer, there may be mentioned amine compounds, nitrile compounds and compounds of sulfur, phosphor, nitrogen, chlorine, etc.

Apparatus and Methods for Curing

Apparatus and methods for curing the curable coating compositions described herein by subjecting them to suitable forms of radiation are well known, and any suitable radiation curing process can be used. For example, the coating can be cured by subjecting it to ultraviolet radiation of suitable intensity from medium pressure mercury arc lamps or other sources of ultraviolet radiation. High energy ionizing radiation such as X-rays, gamma rays, beta rays and accelerated electrons can also be used to accomplish curing of the coating. Typically, the radiation used should be of a sufficient intensity to penetrate substantially all the way through the coated layer. The total dosage employed should be sufficient to bring about curing of the radiation curable coating composition to form a solid layer.

UV radiation is better suited for non-pigmented or slightly pigmented systems having relatively thin films to allow full penetration of the irradiation. For highly pigmented coatings, polymerization is best achieved by electron beam (EB) curing because EB can penetrate through thicker and opaque films.

UV irradiation is usually carried out employing medium pressure mercury arcs or pulsed xenon arcs. These ultraviolet sources usually are equipped with a cooling installation, an installation to remove the produced ozone and a nitrogen inflow to exclude air from the surface of the product to be cured during radiation processing. An intensity of 40 to 120 W/cm in the 200–400 nm region is usually employed. An example of a commercially available ultraviolet source is IST supplied by Strahlentechnik, Oberboihingen, W. Germany.

There are two types of electron beam accelerators: high energy scanner types and low energy linear-cathode types also called electrocurtain type accelerators. These accelerators are usually equipped with nitrogen inflow. A dose in the range of 0.01 to 10 megarads is employed. Examples of commercially available EB accelerators are PILOT 200 and CB175/60/380 both supplied by Energy Sciences Inc., Geneva, Switzerland.

Curing periods may be adjusted to be very short by proper choice of radiation source, photoinitiator and concentration thereof, prepolymer and reactive diluent, distance between the radiation source and the product to be cured. Curing periods of about 1 second duration are possible, especially in thin film applications such as desired, for example, in coatings. For thicker cured products, curing periods up to 5 minutes, preferably 1–2 minutes, are operable.

The radiation curable coating may be applied to the edges of the radiographic screen by techniques known per se as described in detail hereinafter in the Examples.

Figure 2:
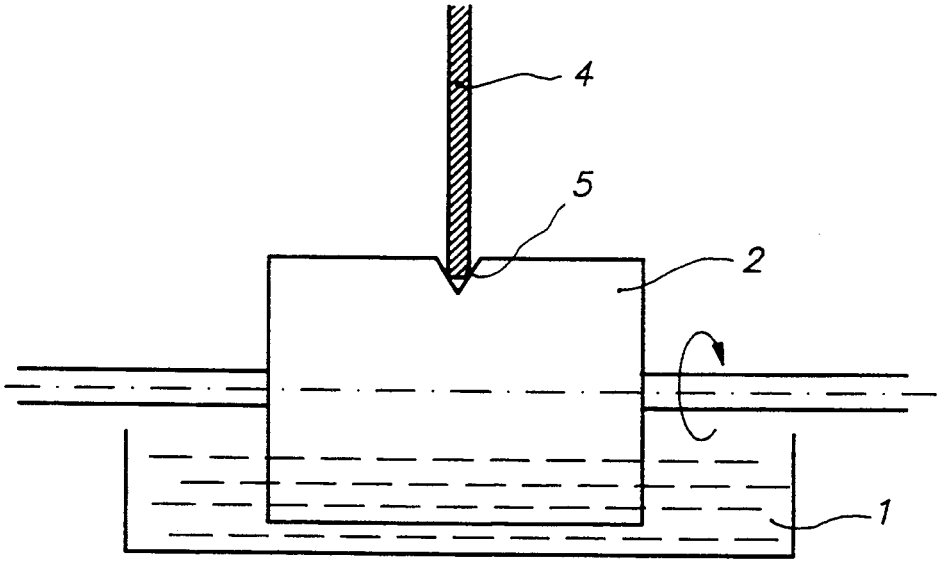

FIG. 1 is a diagrammatic representation of a preferred embodiment of a coating device for applying the radiation curable composition of our invention to the edges of a radiographic screen. FIG. 2 is a diagrammatic representation of the coating device of FIG. 1 according to the arrow A of FIG. 1.

Radiographic Screen

A radiographic screen basically comprises a support and a phosphor layer provided thereon, said phosphor layer comprising a binder and a phosphor dispersed therein. Optionally a radiographic screen may comprise, and in case of stimulable screens, usually comprises, a protective topcoat.

Conventional Phosphur

In the case of a conventional X-ray conversion screen the phosphor used is a fluorescent substance that emits ultraviolet radiation and/or visible light when struck by penetrating X-ray radiation.

The phosphor can be selected from a variety of well-known X-ray luminescent phosphors or phosphor particles taught by the prior art. The phosphors include, for example, calcium tungstate, zinc sulfide, zinc cadmium sulfide, zinc oxide and calcium silicate, zinc phosphate, alkali halides, cadmium sulfide, cadmium selenide, cadmium tungstate, magnesium fluoride, zinc fluoride, strontium sulfide, zinc sulfate, barium lead sulfate, barium fluorohalides, and mixtures of two or more of the above. The above phosphors may be activated with, for example, europium, silver, copper, nickel. Phosphors which are particularly suitable for use in high speed X-ray conversion screens are those selected from fluorescent substances containing elements with atomic number 39 or 57 to 71, which include rare earth elements such as yttrium, gadolinium, lanthanum and cerium. Particularly suitable are the rare earth oxysulfide and oxyhalide fluorescing materials activated with other selected rare earths e.g. lanthanum and gadolinium oxybromide and oxychloride activated with terbium, ytterbium or dysprosium, lanthanum and gadolinium oxysulfides activated with terbium, europium, or a mixture of europium and samarium, yttrium oxide activated with gadolinium, europium, terbium or thulium, yttrium oxysulfide activated with terbium or a mixture of terbium and dysprosium, yttrium tantalate doped with small amounts of terbium or strontium or lithium or a mixture thereof and activated with thulium, niobium, europium, gadolinium, neodymium. These and other rare earth fluorescent material s have been extensively described in the literature for which we refer, e.g., to EP 11909, EP 202875, EP 257138, DE 1282819, DE 1952812, DE 2161958, DE 2329396, DE 2404422, FR 1580544, FR 2021397, FR 2021398, FR 2021399, UK 1206198, UK 1247602, UK 1248968, U.S. Pat. Nos. 3,546,128, 3,725,704, 4,220,551, 4,225,653, also to K. A. Wickersheim et al. "Rare Earth Oxysulfide X-ray Phosphors", in the proceedings of the IEEE Nuclear Science Symposium, San Francisco, Oct. 29–31, 1969, to S. P. Wang et al., IEEE Transactions on Nuclear Science, February, 1970, p. 49–56, and to R. A. Buchanan, IEEE Transactions on Nuclear Science, February, 1972, p. 81–83. A survey of blue light and green light emitting phosphors is given in EP 88820.

By using a plurality of phosphor layers of different composition or by using a radiographic screen containing a mixture of different phosphors a fluorescence over the whole visible spectrum can be obtained, so that such combination is particularly useful for recording with silver halide recording elements that have been made spectrally sensitive for light of the whole visible spectrum.

A particularly preferred two-layer phosphor combination comprises coating on a support as described hereinafter a first phosphor layer on the basis of (Y,Sr-,Li)$TaO_4$.Nb, as disclosed in EP-A-0 202 875, and thereupon a second phosphor layer on the basis of $CaWO_4$. To either of these phosphor layers, in particular to the first phosphor layer may be added colorants in view of the enhancement of the image sharpness. Suitable colorants for this purpose are disclosed in e.g. EP-0 178 592, U.S. Pat. Nos. 3,164,719, 1,477,637, Research Disclosure Nr. 21841.

A radiographic screen comprising a phosphor layer combination on the basis of $CaWO_4$ and in particular $SrYTaO_4$ is described in EP-A-0 240 272.

Stimulable Phosphor

The stimulable phosphor used in a stimulable X-ray conversion screen refers to a phosphor which can exhibit stimulated fluorescence when irradiated with a stimulating excitation light after X-ray irradiation. From the viewpoint of practical use, the stimulable phosphor is desired to give stimulated emission in the wavelength region of 300 to 700 nm when excited with stimulating rays in the wavelength region of 400 to 900 nm. Alternatively, stimulable phosphors emitting around 600 nm, such as described in U.S. Pat. No. 4,825,085, can be used. As the stimulable phosphor to be used, there may be mentioned, for example, those described in EP 304121, EP 345903, EP 353805, U.S. Pat. Nos. 3,859,527, 4,236,078, 4,239,968, JP 73/80487, JP 73/80488, JP 73/80489, JP 76/29889, JP 77/30487, JP 78/39277, JP 79/47883, JP 80/12142, JP 80/12143, JP 80/12144=U.S. Pat. No. 4,236,078, JP 80/12145, JP 80/84389, JP 80/160078, JP 81/116777, JP 82/23673, JP 82/23675, JP 82/148285, JP 83/69281, JP 84/56479. The divalent europium activated alkaline earth metal halide phosphors and rare earth element activated rare earth oxyhalide phosphors are particularly preferred, because these show stimulated emission of high luminance.

The stimulable X-ray conversion screen may have a group of stimulable phosphor layers containing one or more stimulable phosphor layers comprising at least one of the stimulable phosphors as mentioned above. The stimulable phosphors to be contained in respective stimulable phosphor layers may be either identical or different.

The stimulable phosphors can be used in any conventional particle size range and distribution. It is generally appreciated that sharper images with less noise are realized with smaller mean particle sizes, but light emission efficiency declines with decreasing particle size. Thus, the optimum mean particle size for a given application is a reflection of the balance between imaging speed and image sharpness desired.

The stimulable phoshors are in the form of a layer applied to a support, or applied as a self-supporting layer or sheet.

Binder

While it is recognized that the phosphor layer does not have to contain a separate binder, in most applications the phosphor layers contain sufficient binder to give structural coherence to the layer. In general, the binders useful in the practice are those conventionally employed in the art and include proteins such as gelatin, polysaccharides such as dextran, gum arabic, and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate, cellulose acetate butyrate, polyvinyl alcohol, polystyrene, polyester, etc. These and other useful binders are disclosed in U.S. Pat. Nos. 2,502,529, 2,887,379, 3,617,285, 3,300,310, 3,300,311, 3,743,833, Research Disclosure 15444. A mixture of two or more of these binders may be used, e.g., a mixture of polyethyl acrylate and cellulose acetobutyrate.

Ratio of Phosphor to Binder

The ratio between the binder and the phosphor may be determined according to the characteristics of the aimed radiographic screen and the nature of the phosphor employed. Generally, the ratio therebetween is within the range of from 1:1 to 1:100 (binder:phosphor, by weight), preferably from 1:10 to 1:25.

Thickness of the Phosphor Layer

The thickness of the phosphor layer, which may differ depending on the sensitivity of the radiographic screen to radiation, the kind of the phosphor, etc., may be within the range of from 10 to 1000 μm, preferably from 50 to 500 μm, more preferably from 150 to 250 μm.

Two or more phosphor layers with different thickness and/or different binder:phosphor ratio and/or different phosphor particle size may be used.

Gradual Screens

Radiographic screens in particular those comprising conventional non-stimulable phosphors as described above can also be in the form of gradual screens, i.e. screens having a gradual intensification along their length and/or width. This can be achieved by graduality in the thickness of the phosphor layer or by graduality in the amount of dye capable of absorbing the light emitted by the phosphor, into the protective layer.

Support Material

Examples of the support material include plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. A plastic film is preferably employed as the support material.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity type radiographic screen.

Examples of preferred supports include polyethylene terephthalate, clear or blue colored or black colored (e.g., LUMIRROR C, type X30 supplied by Toray Industries, Tokyo, Japan), polyethylene terepthalate filled with $TiO_2$ or with $BaSO_4$.

These supports may have thicknesses which may differ depending on the material of the support, and may generally be between 60 and 1000 μm, more preferably between 80 and 500 μm from the standpoint of handling.

Coating of Phosphor Layer

The phosphor layer can be formed on the support, for instance, by the following procedure.

Phosphor particles and a binder are added to an appropriate solvent as described hereinafter, and then mixed to prepare a coating dispersion comprising the phosphor particles homogeneously dispersed in the binder solution. Said coating dispersion may further comprise a dispersing agent and plasticizer and filler material as described hereinafter.

The coating dispersion containing the phosphor particles and the binder is applied uniformly onto the surface of the support to form a layer of the coating dispersion. The coating procedure may proceed according to any conventional method such as doctor blade coating, dip-coating or roll coating.

After applying the coating dispersion onto the support, the coating dispersion is then heated slowly to dryness so as to complete the formation of a phosphor layer.

Solvent

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, butanone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether; methyl glycol; and mixtures of the abovementioned compounds.

Dispersing Agent

The coating dispersion may contain a dispersing agent to improve the dispersibility of the phosphor particles therein, and may contain a variety of additives such as a plasticizer for increasing the bonding between the binder and the phosphor particles in the phosphor layer.

Examples of the dispersing agent include ionic and nonionic well-known dispersing agents or combinations thereof, e.g., GAFAC RM 610 (tradename) supplied by General Aniline and Film Company (GAF), New York, USA, being polyoxyethylene (20) sorbitan monopalmitate and monolaurate, polymeric surfactant such as acrylic graft copolymer, PHOSPHOLIPON 90 (tradename) supplied by Nattermann-Phospholipid GmbH, Köln, W. Germany, silane dispersing agents such as SILANE Z6040 (tradename) supplied by Dow Corning Corporation, Midland, Mich., USA or glymo 3-glycidyloxypropylmethoxysilane or organosulfate polysilanes, unsaturated p-aminamide salts and high molecular acid esters such as ANTI TERRA U 80 (tradename) supplied by BYK-Chemie GmbH, Wesel, W. Germany, high molecular unsaturated polyesters. Dispersing agents are added in an amount of 0.05 to 10% by weight as compared to the phosphor.

Plasticizer

Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

Filler

The coating dispersion may also contain a filler (reflecting or absorbing) or may be colored by a colorant capable of absorbing light within the spectrum emitted by the phosphor or capable of absorbing excitation light in the case of a stimulable X-ray conversion screen. Examples of colorants include Solvent Orange 71 (Diaresin Red 7), Solvent Violet 32 (Diaresin Violet A), Solvent Yellow 103 (Diaresin Yellow C) and Solvent Green 20 (all four supplied by Mitsubishi Chemical Industries, Japan) Makrolex Rot GS Makrolex Rot EG Makrolex Rot E2G Helioechtgelb 4G and Helioechtgelb HRN (all five supplied by Bayer, Leverkusen, W. Germany), Neozaponfeuerrot G and Zaponechtbraun BE (both supplied by BASF, Ludwigshafen, W. Germany).

Ultrasonic Treatment

An ultrasonic treatment can be applied to improve the packing density and to perform the de-aeration of the phosphor-binder combination.

The phosphor layer can be provided onto the support by methods other than those given above. For instance, the phosphor is initially prepared on a sheet (temporary support) such as a glass plate, metal plate or plastic sheet using the aforementioned coating dispersion and then thus prepared phosphor layer is superposed on the permanent support by pressing or using an adhesive agent. Or, the phosphor layer may be applied to the support by employing a method such as vapor deposition, sputtering, spraying, etc.

Subbing, Light-Reflecting Layer

In the preparation of a radiographic screen, one or more additional layers are occasionally provided between the support and the phosphor layer, so as to enhance the bonding between the support and the phosphor layer, or to improve the sensitivity of the screen or the quality of an image provided thereby. For instance, a subbing layer or an adhesive layer may be provided by coating polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. Such a layer may be coated on the support either as a backing layer or interposed between the support and the active layer. One or more of these additional layers may be provided on the support.

Protective Overcoat

On the surface of the (stimulable) phosphor layer not facing the support, a protective overcoat may be provided.

Said protective overcoat may be formed by a process in which a coating liquid containing at least one of a radiation curing type resin is applied onto the face of the (stimulable) phosphor layer and is subjected to irradiation by ultraviolet rays or electron beam to carry out curing of the coating liquid.

The monomers and prepolymers in said coating composition are selected in order to provide a crosslinking reaction for forming a solvent insoluble layer having good abrasion resistance.

The radiation curing type resin is e.g. an unsaturated polyester or an urethaneacrylate.

To the prepolymer which is the abovementioned radiation curing type resin, there may be added, if necessary, a vinylmonomer as a reactive diluent, a non-reactive binder, a crosslinking agent, a photoinitiator, a photosensitizer, a storage stabilizer, a colorant, and other additives, and then dispersed therein to prepare the coating liquid for the protective layer. Examples of colorants that can be used in the protective layer include MAKROLEX ROT EG, MAKROLEX ROT GS and MAKROLEX ROT E2G, all three supplied by Bayer, Leverkusen, W. Germany.

A difunctional acrylate e.g. hexane diol diacrylate is preferably added as reactive diluent in an amount of between 0 and 80% by weight, preferably between 10 and 30% by weight. Higher functional acrylates would yield hard and brittle layers.

When using ultraviolet radiation as curing source the photoinitiator which needs to be added to the coating solution will to a more or less extent also absorb the light emitted by the phosphor thereby impairing the sensitivity of the radiographic screen, particularly when a phosphor emitting UV or blue light is used. In case of use of a green emitting phosphor a photoinitiator has to be chosen of which the absorption range overlaps to a minimum degree with the emission range of the phosphor; a preferred photoinitiator is then DAROCUR 1173 as abovementioned.

The amount of the photoinitiator used is preferably within the range of 0.01 to 5 parts by weight relative to 100 parts by weight of the prepolymer. In particular, the photoinitiator is preferably used in an amount of 0.5 to 3 parts by weight and within the range of 3 to 7 times the amount of the radical-generating compound used.

To avoid the use of photoinitiators curing by means of electron beam is particularly preferred in radiographic screen applications.

A variety of other optional materials can be included in said surface coating of the radiographic screen, such as materials to reduce static electrical charge accumulation, plasticizers, matting agents, lubricants, defoamers and the like.

Lubricants/Defoamers/Antistats

Examples of lubricants that may be added include silicones such as SURFACTANT 190 supplied by Dow Corning Corporation, Midland, Mich., USA, fluorine containing compounds such as polytetrafluoroethylene and LANCO WAX supplied by Georg M. Langer & Co., Bremen, W. Germany, waxes such as ACRAWAX supplied by Glyco Products, New York, USA and LANCO GLIDD supplied by Georg M. Langer & Co., Bremen, W. Germany. The lubricants are added in amounts varying between 0.01 and 0.5% by weight.

Examples of defoamers that may be added include LANCO ANTIBUBBLE L and LANCO FOAMSTOP PL both supplied by Georg M. Langer & Co., Bremen, W. Germany.

Although antistats are more commonly included in the radiographic element which comes into contact with the radiographic screen small amounts of conventional antistatics may be added to the topcoat or to the active layer. Especially for the conventional X-ray conversion screens static electricity is usually built up during the exchange of the film into and out of the area or cassette containing the X-ray screens. This has been known to cause static marks by exposure of the sensitive photographic film. This cannot be tolerated.

Particularly preferred antistats for incorporation in the phosphor layer or in the said radiation cured protective overcoat, and also for incorporation in other types of protective coatings formed of an organic film-forming polymer such as cellulose nitrate, cellulose acetate, polymethyl methacrylate and the like, are polyethylene oxides, preferably corresponding to the formula $RO—(CH_2CH_2O)_n—H$ with $n=2$ and $R=$cetyl or stearyl or oleyl. These compounds are added in an amount of 0–10% by weight, preferably 2–4% by weight. Using these compounds in combination with anionic or cationic antistats (e.g. quaternary ammonium salts) leads to a synergetic effect.

The thickness of the protective layer formed according to the abovementioned process may be within the range of from 1 to 100 μm, more preferably from 2 to 20 μm.

Coating Protective Layer

To form the protective layer, the composition is coated at a suitable wet thickness (preferably between 60 and 100 μm) and cured by subjecting it to radiation which converts it to a solid form. Any suitable method for coating a thin uniform layer of the composition can be employed. Examples of suitable coating methods include dip coating, air-knife coating, roll coating, extrusion coating, bead coating, curtain coating, and so forth.

The invention will now be illustrated hereinafter by means of examples.

EXAMPLE 1

Comparative Example

Preparation of the Radiographic Screen

A radiographic screen provided with a radiation cured coating was prepared as follows.

Green emitting gadolinium oxysulfide phosphor (80% by weight) was predispersed in a low viscous presolution (20% by weight) of low binder content, together with a dispersant, by stirring for 5 minutes at 1700 rpm. The presolution consisted of 7% by weight of polyethyl acrylate binder (PLEXISOL B 372 supplied by Röhm GmbH, Darmstadt, W. Germany), 18% by weight of ethylacetate, 50% by weight of methyl ethyl ketone, 24.5% by weight of methylglycol and 0.5% of GAFAC RM 610 (supplied by GAF, New York, USA). Subsequently, polyethyl acrylate binder and ethylacetate solvent was added to the phosphor predispersion so as to attain a solution with a solid content of 70%, with 89% by weight of phosphor against 11% of binder.

The obtained phosphor dispersion was applied to a black colored subbed polyethylene terepthalate support by doctor blade coating (wet thickness 900 μm). After evaporation of the solvent a phosphor layer of 160 μm thickness was obtained.

A radiation curable coating composition was prepared comprising 80% by weight of a mixture of 80% of an aromatic urethaneacrylate (EBC 220 supplied by UCB, Drogenbos, Belgium) and 20% of an aliphatic urethaneacrylate (EBC 264 supplied by UCB, Drogenbos, Belgium), 15% by weight of hexane diol diacrylate (HDDA), 4.5% by weight of photoinitiator (DAROCUR 1173 supplied by E. Merck, Darmstadt, W. Germany) and 0.5% by weight of a silicone surfactant. To this composition was added ethanol as solvent in an amount so as to obtain a 25 wt. % solution.

The composition was applied onto the phosphor layer by dip coating (wet thickness about 100 μm). After evaporation of the solvent a topcoat layer having a thickness of 10–15 μm was obtained.

The coating was cured by UV radiation using a Labcure Unit supplied by Technigraf GmbH, Grävenwiesbach, W. Germany ($O_3$ removal, air cooling, energy output of 80 W/cm, velocity 5 m/min, distance UV source-substrate 11 cm). The radiographic screen prepared according to this procedure is referred to below as (I)

Preparation of Comparative Radiation Curable Composition for Performing Edge-Reinforcement A radiation curable coating was prepared comprising 75% by weight of a mixture of 80% of an aromatic urethaneacrylate (EBC 220 supplied by UCB, Drogenbos, Belgium) and 20% of an aliphatic urethaneacrylate (EBC 264 supplied by UCB, Drogenbos, Belgium), and 25% by weight of hexane diol diacrylate (HDDA); to this composition was added 5% by weight of photoinitiator (DAROCUR 1173 supplied by E. Merck, Darmstadt, W. Germany) and 0.5% by weight of a silicone surfactant. The so obtained mixture was dissolved in ethanol so as to obtain a 35 wt. % solution.

The composition was applied onto the edges of the screen (I) as follows:

As set forth above FIG. 1 is a diagrammatic representation of a preferred embodiment of a coating device for applying the radiation curable composition of our invention to the edges of a radiographic screen.

(1) represents a bath of the radiation curable composition;
(2) represents a rotating roller;
(3) represents a doctor blade;
(4) represents the radiographic screen, the edges of which are to be reinforced.

By rotation of the rotating roller (2) in the bath, radiation curable composition (1) was taken up, the excess amount was removed by the doctor blade (2) positioned near to the rotating drum (2) and the screen (I) (4) was moved countercurrently to the sense of direction of the rotating drum (2). FIG. 2 is a diagrammatic side view according to the arrow A of the coating device of FIG. 1. Herein, the screen (4) is shown moving in the peripheral groove (5) of the rotating drum (2). Hereby the edges of the screen (4) are wetted by the radiation curable composition in the bath (1).

The amount of radiation curable composition adhering to the edges of the screen, was determined i.a. by regulating the viscosity of the radiation curable composition, the latter parameter being determined by the amount of solvent added to said composition.

In this case the viscosity of the radiation curable solution was optimal for forming an edge-reinforcing coating on the radiographic screen (I) when as aforementioned, ethanol as solvent was added in an amount so as to obtain a 35 weight % solution of the radiation curable composition.

The wet thickness of the radiation curable composition transferred to the edges of the screen amounted to approximately 100 micron.

After evaporation of the solvent an edge coating layer having a thickness of 10–15 μm was obtained.

The coating was cured by UV radiation using a Labcure Unit supplied by Technigraf GmbH, Grävenwiesbach, W. Germany ($O_3$ removal, air cooling, energy output of 80 W/cm, velocity 5 m/min, distance UV source-edges 11 cm).

EXAMPLE 2

Comparative Example

The edges of the screen (I) prepared according to the procedure described in Example 1 were reinforced by applying a radiation curable composition as described in Example 1 with the difference however that this composition comprised for 75% by weight of a mixture of 80% of an aliphatic urethane acrylate (EBC 1290 supplied by UCB, Drogenbos, Belgium) and 20% of an aliphatic urethane acrylate (EBC 294 supplied by UCB, Drogenbos, Belgium) instead of the mixture of aromatic/aliphatic urethaneacrylates described in Example 1, all other ingredients of the radiation curable coating composition remaining the same as in Example 1. The method of applying said radiation curable composition to the edges of screen (I) was as described in Example 1.

EXAMPLE 3

Invention Example

The edges of the screen (I) prepared according to the procedure described in Example 1 were reinforced by applying a radiation curable composition comprising 30% by weight of a polyester copolymer comprising ethylene terephthalate/ethylene isophthalate (Vitel PE 200, supplied by Goodyear Chemicals Akron, Ohio, USA) and 70% by weight of hexane diol diacrylate. To this composition was added, as in Example 1, 5% by weight of photoinitiator (DAROCUR 1173) and 0.5% by weight of a silicone surfactant. The method of applying said radiation curable composition to the edges of screen (I) was as described in Example 1.

EXAMPLE 4/5

Invention Examples

The procedure set forth under Example 3 was repeated with the difference however that instead of Vitel PE200, a copolyester copolymer was used being a copolyester of terephthalic acid with oxyethylated, resp. oxypropylated Bisphenol A. The molar ratio of oxyethylated vs. oxypropylated Bisphenol A amounted to 25/75 for Example 5 (ATLAC KTR 2300, supplied by Imperial Chemical Industries Ltd. (I.C.I.), U.K.) and to 30/70 for Example 6 (ATLAC KTR 2959, supplied also by I.C.I., aforementioned)

EXAMPLE 6

Invention Example

The edges of the screen (I) prepared according to the procedure described in Example 1 were reinforced by applying a radiation curable composition comprising 40% by weight of Vitel PE200 and 60% by weight of methylmethacrylate (MMA). To this composition was then added 10% by weight of the photoinitiator DAROCUR 1173 and 0.5% by weight of a silicone surfacsant.

EXAMPLE 7

Invention Example

The procedure set forth under Example 6 was repeated with the following difference however: the radiation curable composition was prepared comprising 60% by weight of tetrahydrofurfurylmethacrylate (THFMA), instead of methylmethacrylate as diluent solvent.

Evaluation

The mechanical strength, abrasion resistance and in particular the adhesive properties of the curable compositions of the above Examples when used as edge-reinforcing coating on the radiographic screen (I) were then tested.

Taking into account that all of the edge reinforcing coatings described in the above Examples were radiation curable compositions, the mechanical strength inclusive of the abrasion resistance, of the edges of the screens reinforced by any of the coatings of the examples, was generally satisfactory. However, important differences as to the adhesive properties of the edge reinforcing coating to the edges of the screen were noted. It is clear that when the adhesion of the edge reinforcing coating to the edges of the screen is poor, the edge protective coating tends to easily loose from the edges of the screen and its inherent abrasion resistance effect consequently also vanishes.

The adherence of the edge reinforcing coating to the edges of the screen was tested i.a. in the following two tests:

Peeling test: a piece of tape (Tesatape type 4101, supplied by Beiersdorf AG, Hamburg, W. Germany) was applied firmly to the edge reinforcing coating on the edge of the radiograpic screen and subsequently ripped off. The adherence of the edge reinforcing coating onto the edges of the screen was checked visually on the tearing off of the edge reinforcing coating together with the tape. This adherence test was also repeated after the edge reinforcing coating was slightly damaged by deliberately introducing small cuttings into said coating.

Bending test: Radiographic screens, the edges whereof were reinforced by any of the coatings described in the abovementioned Examples were bended. Hereby tensions are introduced in particular around the edges of the screens, these tensions possibly causing a rupture of the edge reinforcing layer from the screen.

Now the results of executing the above tests to the edge reinforcing coatings of our Examples were as follows:

When the curable coating composition of the Examples 1 and 2 were used for forming an edge-reinforcement layer on a radiographic screen, the results of both the peeling and bending test were negative: i.e., the edge protective layer showed very poor adhesive properties to the edges of the radiographic screen, and therefore was not suited for achieving the objects of our invention set forth supra.

When the curable coating compositions of Example 3 was used, the result of the peeling test was still poor, and a slight improvement of the result of the bending test was noted; however this improvement was still insufficient for meeting the objects set forth supra.

When the curable coating compositions of Examples 4 and 5 were used, the results of the peeling test were slightly improved and the bending test showed generally satisfactory results.

When the curable coating compositions of Examples 6 and 7 were used, surprisingly good results of as well the bending and the peeling test were noted, thereby meeting the objects of our invention.

For sake of clarity the results of the peeling and bending test are summarized hereinafter in the following Table 1 with indication for each Example of the type of prepolymer and diluent monomer used.

TABLE 1

| Example No. | Prepolymer Monomer | Diluent | Result Peeling Test | Result Bending Test |
|---|---|---|---|---|
| 1 | EBC 220 + EBC 264 | HDDA | − | − |
| 2 | EBC 1290 + EBC 294 | HDDA | − | − |
| 3 | Vitel PE 200 | HDDA | − | ± |
| 4 | ATLAC KTR 2300 | HDDA | ± | + |
| 5 | ATLAC KTR 2959 | HDDA | ± | + |
| 6 | Vitel PE 200 | MMA | + | + |
| 7 | Vitel PE 200 | THFMA | + | + |

As a result of the above experiments, it may be set forth that so as to obtain curable coating compositions suitable for forming edge-reinforcing coatings with good adhesion properties to the radiographic screen structure including the base support made of polyethylene terephthalate, the phosphor-binder layer, and a cured protective topcoat, said compositions should comprise a polyester type prepolymer dissolved in a diluent mono-functional monomer.

As is apparent from the above examples such a monofunctional monomer is preferably an acrylate compound such as methyl-methacrylate or tetrahydrofurfurylmethacrylate. The best results in terms of adhesive properties of the edge-coating layer to the radiographic screen were obtained when as prepolymer a polyester compound such as Vitel PE 200, being a copolymer comprising ethylene terephthalate/ethylene isophthalate units was used.

Further it has been noted that when the thickness of the edge reinforcing layer exceeds 30 micron, it also more easily looses from the edge of the radiographic screen, as such relatively thick layer becomes brittle and hard. The thickness of such edge reinforcing layer therefore should preferably be less than 20 micron, and more than 5 micron so as to have sufficient mechanical strength.

We claim:

1. Radiographic screen comprising a support, a layer including side edges, said layer comprising a fluorescent phosphor dispersed in a binder and a protective topcoat on said phosphor-binder layer, wherein the side edges of said screen are reinforced with a radiation-cured coating obtained by curing a radiation curable composition containing a copolymer of ethylene terephthalate and ethylene/isophthalate dissolved in a diluent methacrylate monomer selected from the group consisting of methylmethacrylate and tetrahydrofurfurylmethacrylate.

2. A radiographic screen according to claim 1, wherein said radiation-cured coating has a thickness between 5 and 20 microns.

3. A radiographic screen according to claim 1, wherein the protective topcoat over the phosphor layer is a radiation-cured coating.

4. A radiographic screen according to claim 1, wherein said support is a polyethylene terephthalate support.

5. A radiographic screen according to claim 1, wherein said radiation-curable composition comprises a photoinitiator.

6. A radiographic screen according to claim 5, wherein said photoinitiator is 2-hydroxy-2-methyl-1-phenylpropan-1-one.

* * * * *